US006016726A

United States Patent [19]

Wright

[11] Patent Number: 6,016,726

[45] Date of Patent: Jan. 25, 2000

[54] ADJUSTABLE WRENCH

[76] Inventor: Harry W. Wright, 903 W. Cienega Ave., San Dimas, Calif. 91773

[21] Appl. No.: 09/114,560

[22] Filed: Jul. 13, 1998

[51] Int. Cl.[7] ..... B25B 23/16

[52] U.S. Cl. ..... 81/177.7; 81/177.8

[58] Field of Search ..... 81/177.7, 177.8; 403/91, 103, 106, 163

[56] References Cited

U.S. PATENT DOCUMENTS

| | | | |
|---|---|---|---|
| 120,304 | 10/1871 | McBride . | |
| 777,955 | 12/1904 | Kanning . | |
| 1,316,044 | 9/1919 | King . | |
| 1,379,536 | 5/1921 | Davies | 81/177.8 |
| 1,384,887 | 7/1921 | Burndahl . | |
| 1,417,338 | 5/1922 | Lenahan . | |
| 1,432,813 | 10/1922 | Walden | 81/177.8 |
| 1,568,442 | 1/1926 | Carver . | |
| 1,747,527 | 2/1930 | Peterson . | |
| 1,764,379 | 6/1930 | Zilliox . | |
| 1,840,685 | 1/1932 | Witherup . | |
| 3,068,728 | 12/1962 | Shepherd | 81/177.7 |
| 4,170,909 | 10/1979 | Wagner | 81/177.7 |
| 5,101,696 | 4/1992 | Neff | 81/177.8 |
| 5,513,544 | 5/1996 | Winkler et al. | 81/177.8 |
| 5,515,754 | 5/1996 | Elkins | 81/177.7 |

*Primary Examiner*—David A. Scherbel
*Assistant Examiner*—Joni B. Danganan
*Attorney, Agent, or Firm*—Gene Scott-Patent Law & Venture Group

[57] ABSTRACT

A wrench provides for a movable head portion mounted pivotally onto a handle portion. The head portion includes a rod that extends into a slot in the handle portion on each side of the head portion. A blade extends from the head and is engagable within a tubular end of the handle so that the head may be positioned with the blade aligned axially with the handle in a first orientation, or at an angle to the handle in a second orientation so that the wrench may be applied to the flats of nuts which have diverse orientations when space for the positioning of the handle is limited.

3 Claims, 2 Drawing Sheets

ADJUSTABLE WRENCH

BACKGROUND OF THE INVENTION

1. Field of the Invention

This invention relates generally to hand tools, and more particularly to an adjustable wrench with a head movable between two angularly separated specific positions for assuring proper engagement on nuts with any random orientation.

2. Description of Related Art

The following art defines the present state of this field:

Peterson, U.S. Pat. No. 1,747,527 provides means whereby the ends of the wrench may be adjusted to various angels with respect to each other to facilitate the use of the wrench. It also provides a pair of adjusted connected sections means being provided for securing the sections in such a way that the sections will be held stationary with respect to each other, while the wrench is in use. The invention resides in the combination and arrangement of parts and in the details of construction.

Witherup, U.S. Pat. No. 1,840,685 provides that in the use of wrenches it is very often desirable to have the work-engaging surfaces of the wrench placed at different angels, or positions relatively to the handle so that the wrench may be available for handling nuts, or bolts, in otherwise inaccessible positions. The present invention is designed to accomplish this purpose by connecting the handle with the wrench member through a pivotal connection so that the handle may be adjusted to different angles to the wrench member and thus increase its availability. Preferably also the engaging surfaces of the wrench are in a removable end in the wrench member so that different shapes of wrench slots, or wrench sockets may be provided for the wrench member.

Zilliox, U.S. Pat. No. 1,764,379 relates to a wrench and more particularly to an open end machine end wrench in which a plurality of open end machine wrench heads having different sized jaws are employed in connection with the same handle thereby greatly decreasing the cost of a set of such wrenches as well as permitting of a compact and convenient kit. It provides such a handle and open end machine wrench heads therefor in which the heads can be quickly applied to or removed from the handle and when so applied are securely held to the handle and operate reliably to permit the desired pressure to be applied to the object gripped. It also provides such an open end machine wrench which is strong and which will stand up under the severe and constant use to which tools of this character are subjected. It also provides such an open end machine wrench which is simple and inexpensive and in which all of the more expensive manufacturing operations are performed on the handle since only one handle is used in connection with a large number of heads. Another aim is to provide an open end machine wrench of this character in which the head can be held in different positions relative to the handle thereby permitting of its use in places where an open end machine wrench having a head set at a fixed angle could not be employed, and in which such adjustment in the angularity of the head can be effected expeditiously and be reliably held.

Carver, U.S. 1,568,442 relates to a wrench, the jaws of which are removable and interchangeable, and has for its principal object the provision of a wrench of this character in which the angle of projection of the jaws can be quickly and easily adjusted. It also provides a wrench of this character in which the wrench jaws may be easily removed and replaced. It still also provides in the novel means employed for attaching, without the use of screws, bolts, nuts, etc., the wrench jaws to the wrench handle. A still further object is to so construct a flat jawed wrench that it may be readily transformed into a socket wrench.

Burndahl, U.S. Pat. No. 1,384,887 relates to improvements in tool handles and is especially directed to the provision or production of a tool handle which can be used with practically any sort of a tool and in almost any position therefore making it particularly useful in close places. In the embodiment of this invention disclosed in the drawings and specification, this improved tool handle is shown as applied and directed chiefly to a wrench and to a screw driver, but it is to be understood that this handle may be applied to practically any sort of tool and to any desired size thereof. An object of this invention is the provision of a tool handle which when used in connection with a tool such as a wrench, screw driver, or the like, can be adjusted into almost any position at different angles to the tool whereby screws, bolts and the like, which are ordinarily difficult of access, may be reached and turned easily. This device is especially useful in the case of automobiles, where the parts and different members are so closely associated that at times it is practically impossible to reach a particular bolt, screw or nut without first removing quite a number of other parts of the apparatus or the engine which, had a convenient wrench of this sort been available, would have been entirely unnecessary. A further object of this invention is the provision of a tool handle wherein a plurality of tools may be used and where the tools may be changed from one to the other and different sizes of the same sort of tool substituted with a minimum of trouble and inconvenience, and with no loss of time. A still further object of this invention is the provision of a tool handle which, when used in connection with a wrench, screw driver or the like, can be manipulated by means of an adjustment in the handle whereby the bolt, nut, screw or like part may be turned or manipulated without removing the tool from its position or from the head of the bolt screw. Still another important object of this invention is the provision of a tool handle wherein a wrench or screw driver or the like may be operated by only one hand of the operator, thereby leaving the other hand of the operator free to hold the screw or bolt into position or for any other purpose.

Lenahan, U.S. Pat. No. 1,417,338 relates to wrenches of the ratchet type. The object of the invention is to provide a handle and a jaw carrying or gripping member adjustably connected so that said member may be arranged either in alignment with or at any desired angle relatively to the handle thereby adapting it for use in out of the way places and which when so connected is strong and durable and capable of resisting all strains to which it may be subjected.

King, U.S. Pat. No. 1,316,044 relates to new and useful improvements in wrenches and more particularly to what will be termed an automobile wrench, the main object of the invention being the provision of a wrench of the above type which is provided with a plurality of removable heads adapted to fit various parts of the machine and are so mounted that they may be readily changed when desired. Another object of the invention is the provision of a wrench whereby the removable head members may be readily disposed at various desired angles and securely held in a position to gain access to the unhandy places on the machine. A further object of the invention is the provision of a wrench of this character which will possess advantages in points of efficiency and durability, is inexpensive to the manufacture and, at the same time, is simple in construction and operation.

Kanning, U.S. Pat. No. 777,955 relates to wrenches; and the primary object thereof is to provide a wrench having a pivoted head which carries a jaw which may be swung to different positions, so as to readily grasp nuts or taps located in obscure parts of machinery. Another object is to provide a shank having an end with a shoulder or shoulders of standard form and size, and, further to provide heads of standard forms and sizes which will be interchangeable for each other and which will have nut-engaging jaws of various sizes. A further object of this invention is to provide shoulders on the heads which will cooperate with corresponding shoulders on the shank, so that in certain positions of the jaw the shoulders will afford a maximum amount of rigidity.

McBride, U.S. Pat. No. 120,304 relates to an improved wrench, which shall be so constructed that it may be adjusted in different positions to adapt it for turning nuts or bolts in different positions or in any position; and it consists in the construction and combination of the parts of the wrench.

The prior art teaches a number of different approaches to angular positioning of a wrench head with respect to its handle. This kind of a tool is very important. However, the prior art does not teach the specific structural approach of the instant invention which provides advantages as cited in the following summary.

SUMMARY OF THE INVENTION

The present invention teaches certain benefits in construction and use which give rise to the objectives described below.

The present invention provides a wrench having a positionable head portion so as to enable various configurations of the wrench head portion with respect to a wrench handle portion.

A primary objective of the present invention is to provide a wrench with a positionable head having advantages not taught by the prior art.

Another objective is to provide such a wrench with relatively simple yet very rugged construction so as to be cost effective in manufacture yet able to apply a maximum of force to a nut or bolt head.

A further objective is to provide such a wrench whereby the head may take multiple positions by simply moving the head with respect to a tubular holder having a slotted construction.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
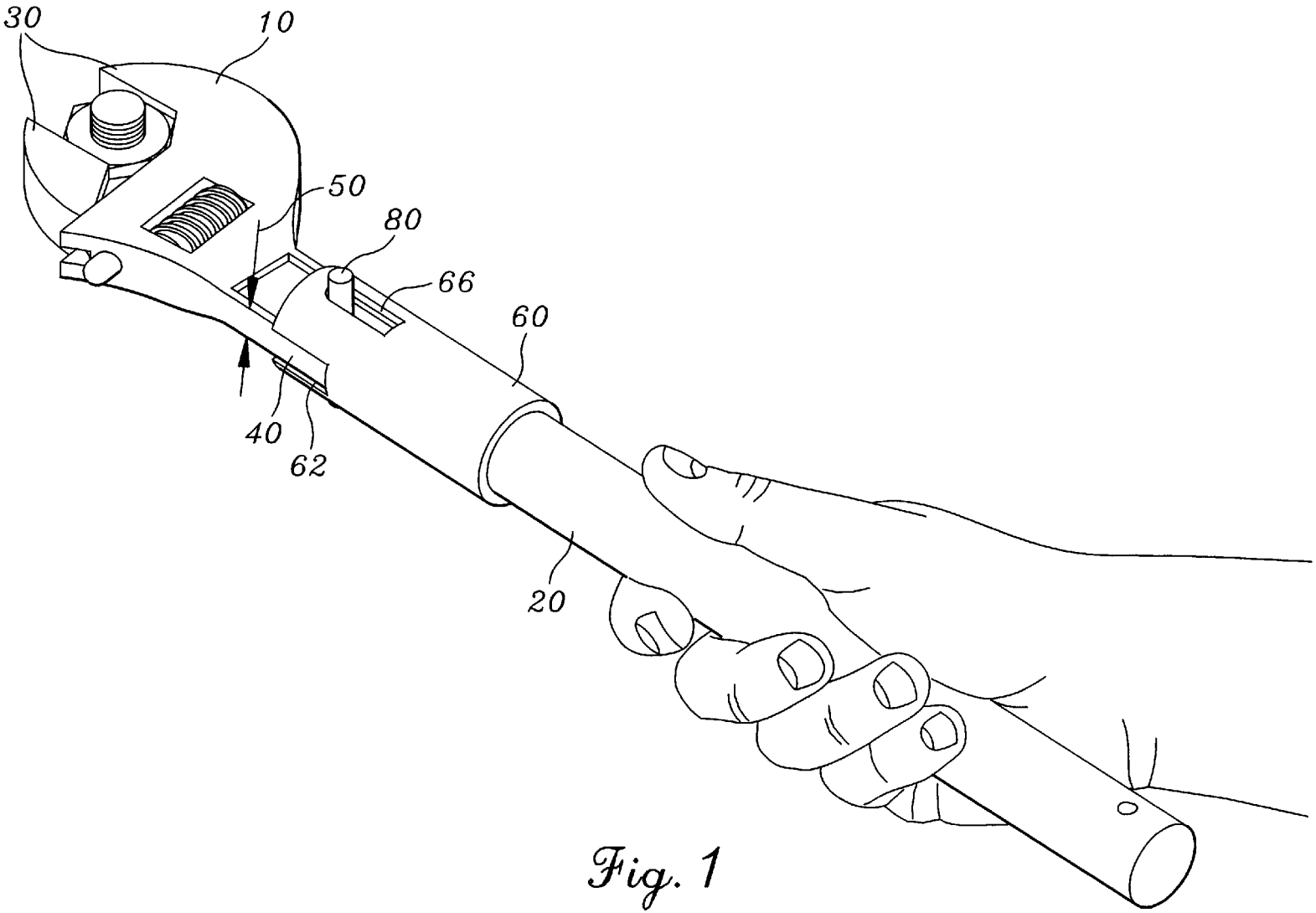
FIG. 1 is a perspective view of the preferred embodiment of the present invention shown engaged with a nut.

The above described drawing figures illustrate the invention, a very strong, multi-positionable wrench apparatus comprising a wrench head portion 10 and a wrench handle portion 20 both made of a strong structural material such as steel. The wrench head portion 10 provides a nut (or bolt head) engaging portion 30 with a blade portion 40 extending therefrom, the blade portion 40 having a blade width 50. Preferably, the nut engaging portion 30 has a pair of jaws 32 and 34 of adjustable spacing, but such is not required in a tool of this type so that the jaws 32 and 34 may just as easily be fixed with respect to one another.

Preferably, the blade width 50 is uniform along the length of the blade portion 40. The wrench handle portion 20 provides a tubular end piece 60 having an inside diameter 70 (FIG. 4) for accepting the blade portion 40 therewithin in snug sliding engagement, as can best be seen in FIG. 2. The tubular end piece 60 further provides a pair of diametrically opposed, open ended slots 62 and 64 for accepting the blade width 50 of the blade portion 40, that is, the slots 62, 64 are wide enough to receive the blade portion 40 when it is rotated into one or both of the slots as shown in FIGS. 3 and 4. The tubular end piece also provides a pair of diametrically opposed closed slots 66 and 68 fixedly positioned at 90° angular rotation with respect to the open ended slots 62 and 64 as clearly shown in FIG. 1. The blade portion 40 further provides a guide pin 80 extending laterally therefrom, on both of its sides, for slidingly engaging the pair of closed slots 66 and 68 when the blade portion 40 is engaged with the tubular end piece 60.

Figure 2:
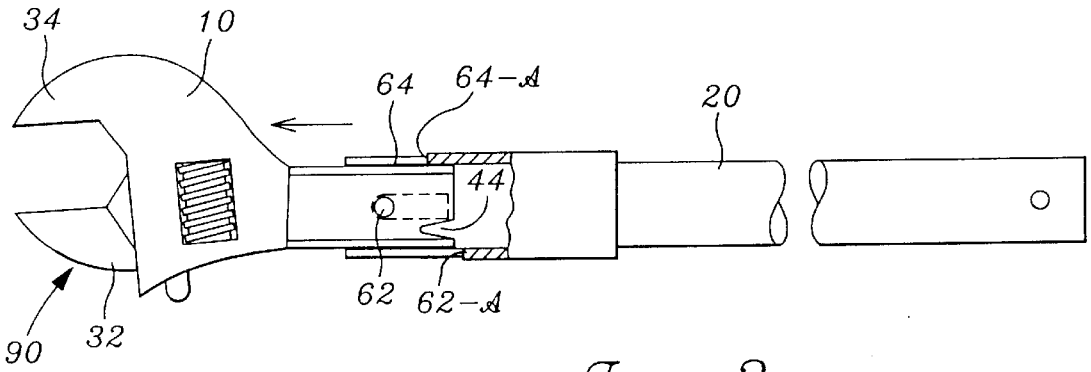
FIG. 2 is a partial cutaway side elevational view thereof shown arranged with a first preferred head position.
Figure 3:
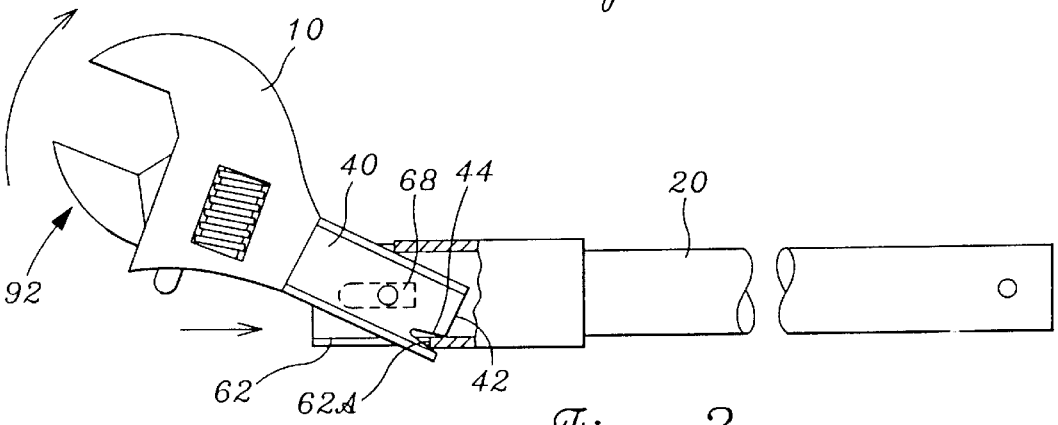
FIG. 3 is a partial cutaway side elevational view thereof shown arranged with a second preferred head position.
Figure 4:
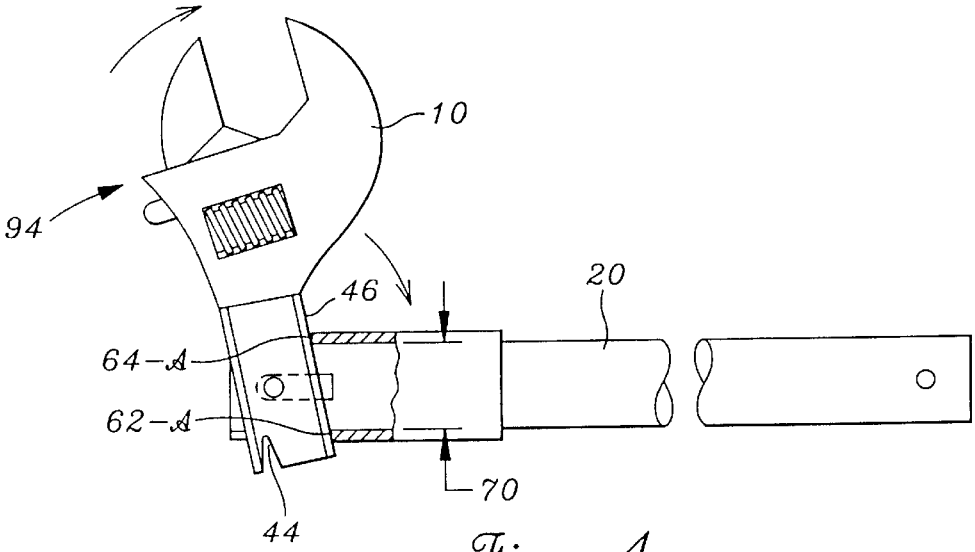
FIG. 4 is a partial cutaway side elevational view thereof shown arranged with a third preferred head position.

The wrench head portion 10 may be positioned with the blade portion 40 inserted within the tubular end piece 60, as shown in FIGS. 1 and 2 for positioning the nut engaging portion 30 in a first preferred attitude 90, as shown in FIGS. 1 and 2, and alternately, the wrench head portion 10 may be rotated to a second preferred attitude 92, as shown in FIG. 3 so that a terminal end 42 of the blade portion 40 extends into the open ended slot 62.

Preferably, the terminal end 42 of the blade portion 40 provides a notch 44 of such position and size as to be engaged with an end sidewall 62-A of the open ended slot 62 so as to secure the wrench head portion 10 in the second preferred attitude 92.

Preferably, the open ended slots 62 and 64 are of such length as to allow a first edge 46 of the blade portion 40 to rest simultaneously against both end side walls 62-A and 64-A of the open ended slots 62 and 64 when the wrench head portion 10 is positioned at a third preferred attitude 94.

Now it should be clear that for positioning the wrench head portion 10 alternatively into positions 90, 92 or 94, slots 66 and 68, on opposing sides of the tubular end piece 60, must be of such position and length as to allow the guide pin 80, which is integral with the blade portion 40, to be moved within the slots 66 and 68, as shown in FIG. 2, so that the terminal end 42 may clear end sidewall 62-A when head portion 10 is rotated to the position as shown in FIG. 3. Then guide pin 80 may be moved to the position shown in FIG. 3 to lock end sidewall 62-A into notch 44 so that head portion 10 is locked in the orientation of FIG. 3. It should be realized that when this is accomplished, the invention may be used to apply a high torque force without putting undue strain on guide pin 80. Notice too, that in this position, first edge 46 abuts end sidewall 64-A. This is critical to the stability of the wrench in exerting a strong torquing force when adjusted to this angle. Likewise, head portion 10 may be rotated further so as to assume the position of FIG. 4, where first edge 46 abuts both of end side walls 62-A and 64-A. In this position 94, however, torque applied by the invention, does apply a force to guide pin 80, so that in position 94, the invention is less viable for use with very high torque applications. Therefore, it is demonstrated that the instant wrench is highly adjustable and is positionable so as to drive nuts whose flats are positioned at various angles when access to such nuts is limited.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A multi-positionable wrench apparatus comprising a wrench head portion and a wrench handle portion, the wrench head portion providing a nut engaging portion with a blade portion extending therefrom, the blade portion having a blade width, the wrench handle portion providing a tubular end piece having an inside diameter for accepting the blade portion therewithin in snug axial sliding engagement, the tubular end piece further providing a pair of diametrically opposed, open ended slots for accepting the blade width of the blade portion, the tubular end piece still further providing a pair of diametrically opposed closed and elongated slots fixedly positioned at 90° angular rotation with respect to the open ended slots, the blade portion further providing a guide pin extending laterally therefrom for engaging the pair of closed slots when the blade portion is engaged with the tubular end piece, such that the wrench head portion may be positioned with the blade portion inserted within the tubular end piece, with the guide pin at a distal end of the enlongated slots, positioning the nut engaging portion in a first preferred attitude and, alternately, the wrench head portion may be positioned with the guide pin medially located in the elongated slots, thereby enabling rotation of the wrench head portion to a second preferred attitude wherein a notch of a terminal end of the blade portion receives one of the open ended slots for locking engagement therein; the first and the second attitudes being angularly displaced.

2. The apparatus of claim 1 wherein the nut engaging portion has a pair of jaws of adjustable spacing.

3. The apparatus of claim 1 wherein the open ended slots are positioned so as to enable a first edge of the blade portion to rest simultaneously against an end side wall of each of the open ended slots when the wrench head portion is positioned into a third preferred attitude enabled by a proximal positioning of the guide pins within the elongated slots.

* * * * *